US007517253B1

(12) United States Patent
Chiang

(10) Patent No.: US 7,517,253 B1
(45) Date of Patent: Apr. 14, 2009

(54) CONNECTOR SOCKET FOR ESATA AND USB PLUGS

(75) Inventor: Jui-Tu Chiang, Jhonghe (TW)

(73) Assignee: Taiwin Electronics Co., Ltd., Jhonghe, Taipei Hsien (TW)

( * ) Notice: Subject to any disclaimer, the term of this patent is extended or adjusted under 35 U.S.C. 154(b) by 0 days.

(21) Appl. No.: 12/229,227

(22) Filed: Aug. 21, 2008

(30) Foreign Application Priority Data

Feb. 1, 2008 (TW) ..... 97202149 U

(51) Int. Cl.
*H01R 24/00* (2006.01)

(52) U.S. Cl. ..... 439/660; 439/218

(58) Field of Classification Search ..... 439/660, 439/676, 607, 356–358, 76.1, 630, 669, 218
See application file for complete search history.

(56) References Cited

U.S. PATENT DOCUMENTS 6,300,874 B1 * 10/2001 Rand ..... 340/568.2
7,232,346 B2 * 6/2007 Hu et al. ..... 439/660
7,252,518 B1 * 8/2007 Ni ..... 439/76.1
7,318,752 B2 * 1/2008 Fujimoto et al. ..... 439/660
7,371,116 B2 * 5/2008 Chiang ..... 439/607
2007/0218762 A1 * 9/2007 Liao et al. ..... 439/607

* cited by examiner

*Primary Examiner*—Neil Abrams
*Assistant Examiner*—Harshad C Patel
(74) *Attorney, Agent, or Firm*—Charles E. Baxley

(57) ABSTRACT

The connector socket has a casing, an eSATA contact set and an USB contact set. The casing has a cavity and a contact seat being disposed in the cavity. The eSATA contact set is mounted on the contact seat and has side eSATA contacts and middle eSATA contacts. The middle eSATA contacts are disposed between the side eSATA contacts and mounted on the contact seat. The USB contact set is mounted on the contact seat opposite to the eSATA contact set and has multiple interior USB contacts and multiple exterior USB contacts. The exterior USB contacts respectively connect the middle eSATA contacts to transmit signals via the middle eSATA contacts. Therefore the connector socket is compatible with USB 3.0 specification and is compact with the single contact seat.

9 Claims, 9 Drawing Sheets

CONNECTOR SOCKET FOR ESATA AND USB PLUGS

BACKGROUND OF THE INVENTION

1. Field of the Invention

The present invention relates to a connector socket, especially to a connector socket that may receive External Serial ATA (eSATA) or Universal Serial Bus (USB) plugs and is compact and compatible with USB 3.0 specification.

2. Description of the Related Art

With the development of technology, electronic products are widely used in daily life and capable of communicate with each other through data transmission cables. And each electronic product has at least one connector socket for connectors of said data transmission cables to plug therein. The type of the at least one connector socket may be USB (Universal Serial Bus) or External Serial Advanced Technology Attachment (eSATA).

With reference to FIG. 9, a conventional connector socket is developed to have both USB and eSATA interfaces and has a casing (50), a contact seat (51), an USB 2.0 contact set (52) and an eSATA contact set (53). The USB 2.0 contact set (52) is mounted on a bottom of the contact seat (51) and has four USB contacts (520) being compatible with an USB 2.0 plug. The eSATA contact set (53) is mounted on a top of the contact seat (51), opposite to the USB 2.0 contact set (52) and has seven eSATA contacts (530) being compatible with an eSATA plug. Therefore the conventional connector socket is adapted to be connect to an USB 2.0 plug or an eSATA plug.

However, with the requirement of data transmission speed is higher and higher, the speed of a USB 2.0 plug is insufficient to support high-speed transmission between external devices. Therefore the USB specification is developed at a higher version of USB 3.0.

With reference to FIG. 10, a standard USB 3.0 plug (40) is designed to be backwards-compatible with USB 2.0 and USB 1.1 and has a cavity (41), multiple rear contacts (43) and multiple front contacts (42). The cavity (41) has a front opening. The rear contacts (43) are mounted in the cavity (41) and arranged in a row. The front contacts (42) are mounted in the cavity (41) closer to the front opening and arranged in a row. Since having much more contacts, the USB 3.0 plug can accelerate data transmission to 4.8 Gbps.

Even though the USB 3.0 plug (40) is compatible with a USB 2.0 connector socket, the USB 2.0 connector socket can not perform a full transmission speed of USB 3.0 since the connector socket do not have as much contacts. Therefore the foregoing conventional connector socket will limit transmission speed while connecting to an USB 3.0 plug and lead to time-consuming.

To overcome the shortcomings, the present invention provides a connector socket to mitigate or obviate the aforementioned problems.

SUMMARY OF THE INVENTION

The main objective of the invention is to provide a connector socket that may receive External Serial ATA (eSATA) or Universal Serial Bus (USB) plugs and is compact and compatible with USB 3.0 specification.

The connector socket comprises a casing, an eSATA contact set and an USB contact set. The casing has a cavity and a contact seat being disposed in the cavity. The eSATA contact set is mounted on the contact seat and has side eSATA contacts and middle eSATA contacts. The side eSATA contacts are mounted on the contact seat. The middle eSATA contacts are disposed between the side eSATA contacts and mounted on the contact seat. The USB contact set is mounted on the contact seat opposite to the eSATA contact set and has multiple interior USB contacts and multiple exterior USB contacts. The interior USB contacts are mounted on the contact seat. The exterior USB contacts are mounted on the contact seat and respectively connect the middle eSATA contacts to transmit signals via the middle eSATA contacts. Therefore the connector socket is compatible with eSATA and USB 3.0 and is compact with the single contact seat.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
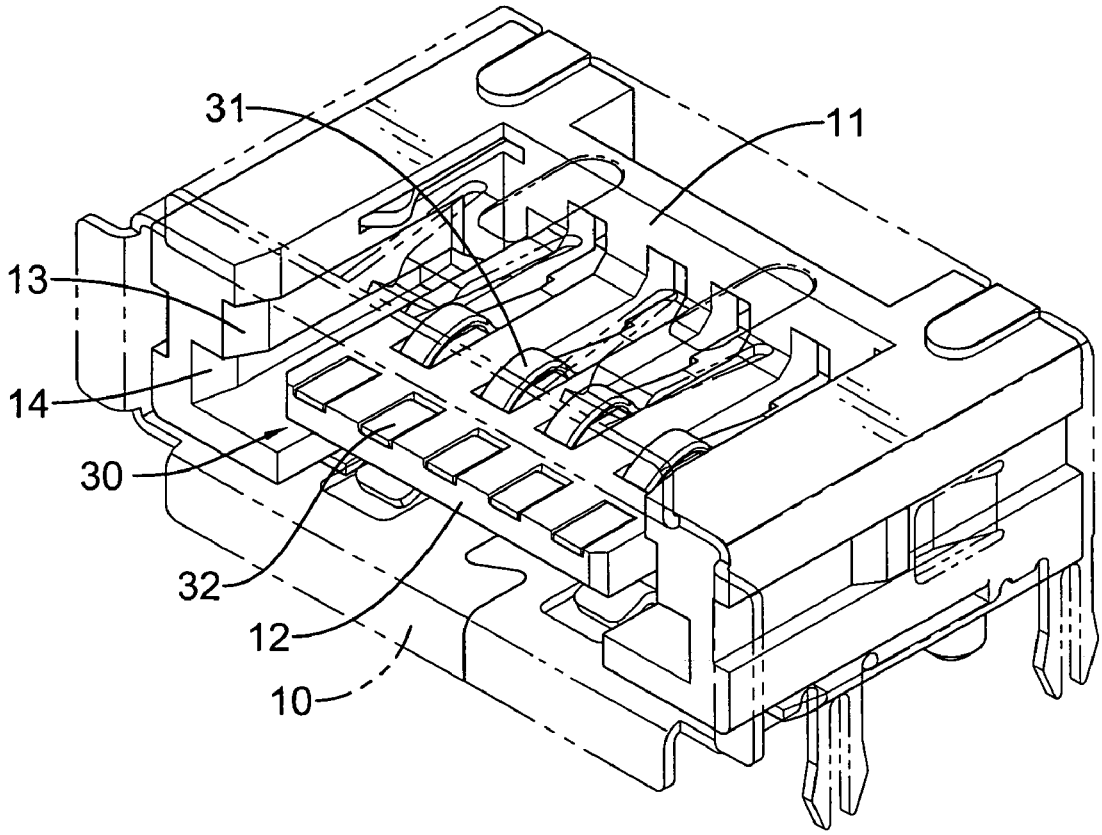
FIG. 1 is a perspective view of a first embodiment of a connector socket in accordance with the present invention.
Figure 2:
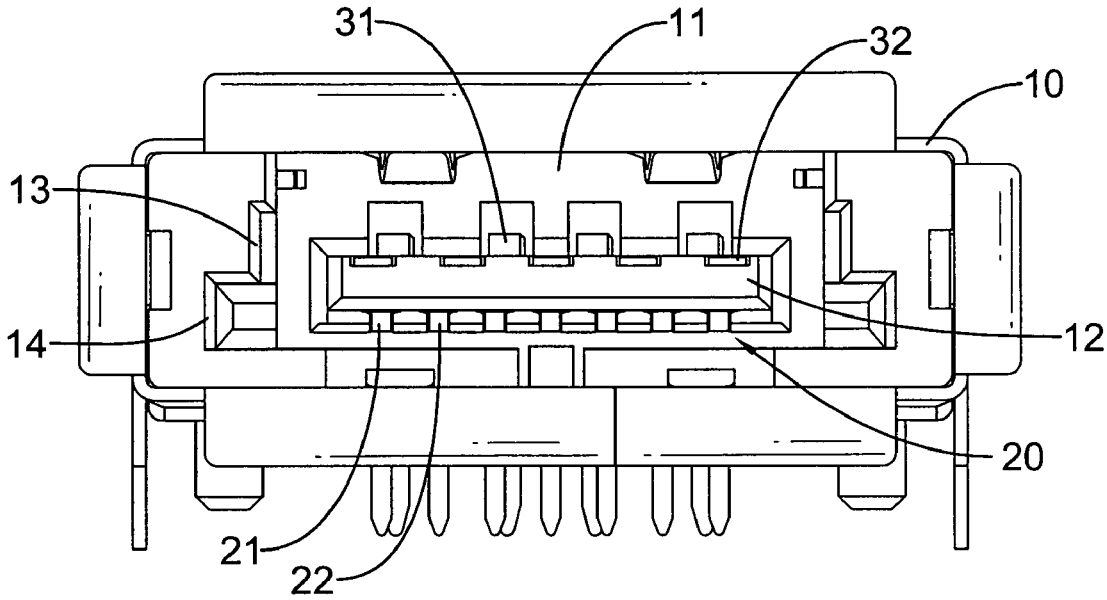
FIG. 2 is a front view of the connector socket in FIG. 1.

With reference to FIGS. 1, 2, 5 and 6, a connector socket in accordance with the present invention comprises a casing (10), an eSATA contact set (20) and an USB contact set (30).

The casing (10) has a cavity (11) and a contact seat (12). The cavity (11) is defined in the casing (10) and may have a front opening. The front opening may have an edge having stepped segments and forming an USB plug outline (13) and an eSATA plug outline (14). The USB plug outline (13) is adapted to correspond to an USB plug and allows the USB plug to be mounted securely in the cavity (11) therethrough. The eSATA plug outline (14) is adapted to correspond to an eSATA plug and allows the eSATA plug to be mounted securely in the cavity (11) therethrough and may be wider than the USB plug outline (13). The contact seat (12) is disposed in the cavity (11) and may have a top surface and a bottom surface opposite to the top surface.

The eSATA contact set (20) is mounted on the contact seat (12) and has side eSATA contacts (21) and middle eSATA contacts (22). The side eSATA contacts (21) are conductive and mounted on the contact seat (12). The middle eSATA contacts (22) are conductive, arranged in a row between the side eSATA contacts (21) and mounted on the contact seat (12). Each middle eSATA contact (22) may have a front end and an extension (23). The front end may be close to the front opening of the cavity (11). The extension (23) is formed on and protrudes inclined down from the front end.

The USB contact set (30) is mounted on the contact seat (12) opposite to the eSATA contact set (20) and has multiple interior USB contacts (31) and multiple exterior USB contacts (32). The interior USB contacts (31) are conductive and mounted on the contact seat (12). The exterior USB contacts (32) are conductive, mounted on the contact seat (12), arranged in a row, close to the front opening and respectively connect the middle eSATA contacts (22). The exterior USB contacts (32) transmit data via the middle eSATA contacts (22) and cooperate with the interior USB contacts (31) to be compatible with a USB 3.0 plug and accelerate data transmission speed.

Figure 3:
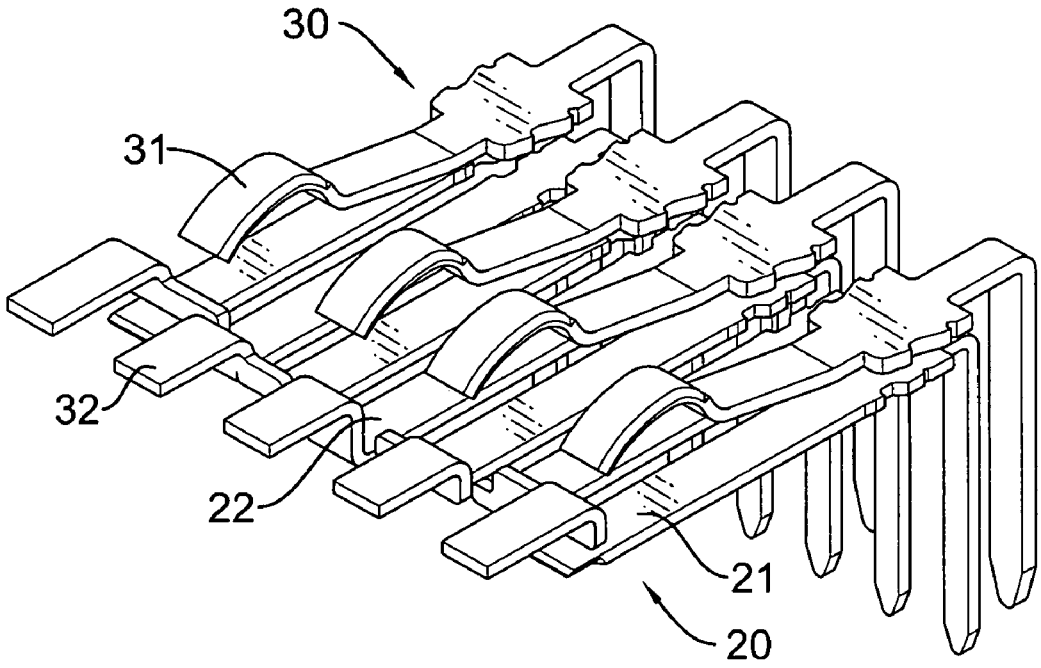
FIG. 3 is a perspective view of an eSATA contact set and an USB contact set of the connector socket in FIG. 1.
Figure 4:
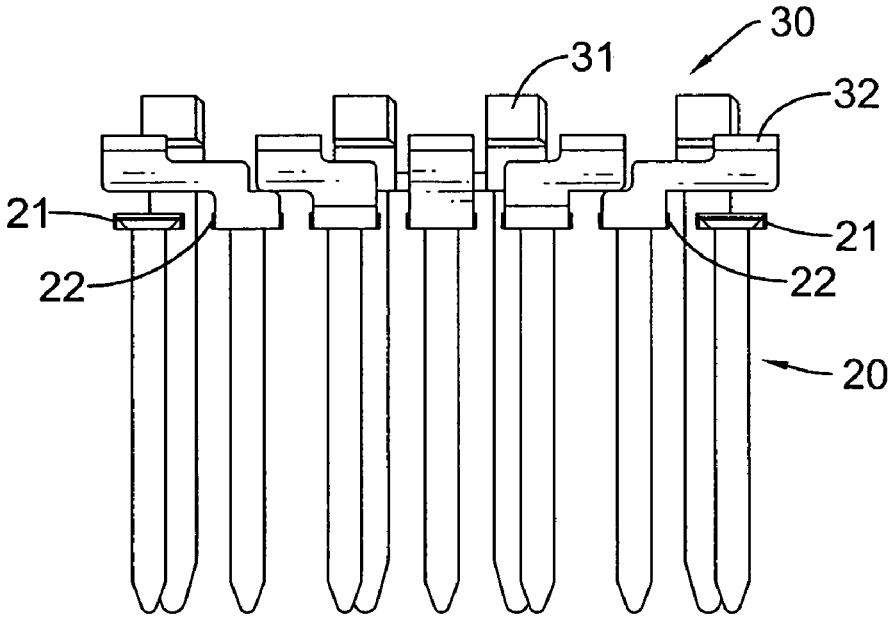
FIG. 4 is a front view of the eSATA contact set and the USB contact set in FIG. 3.
Figure 5:
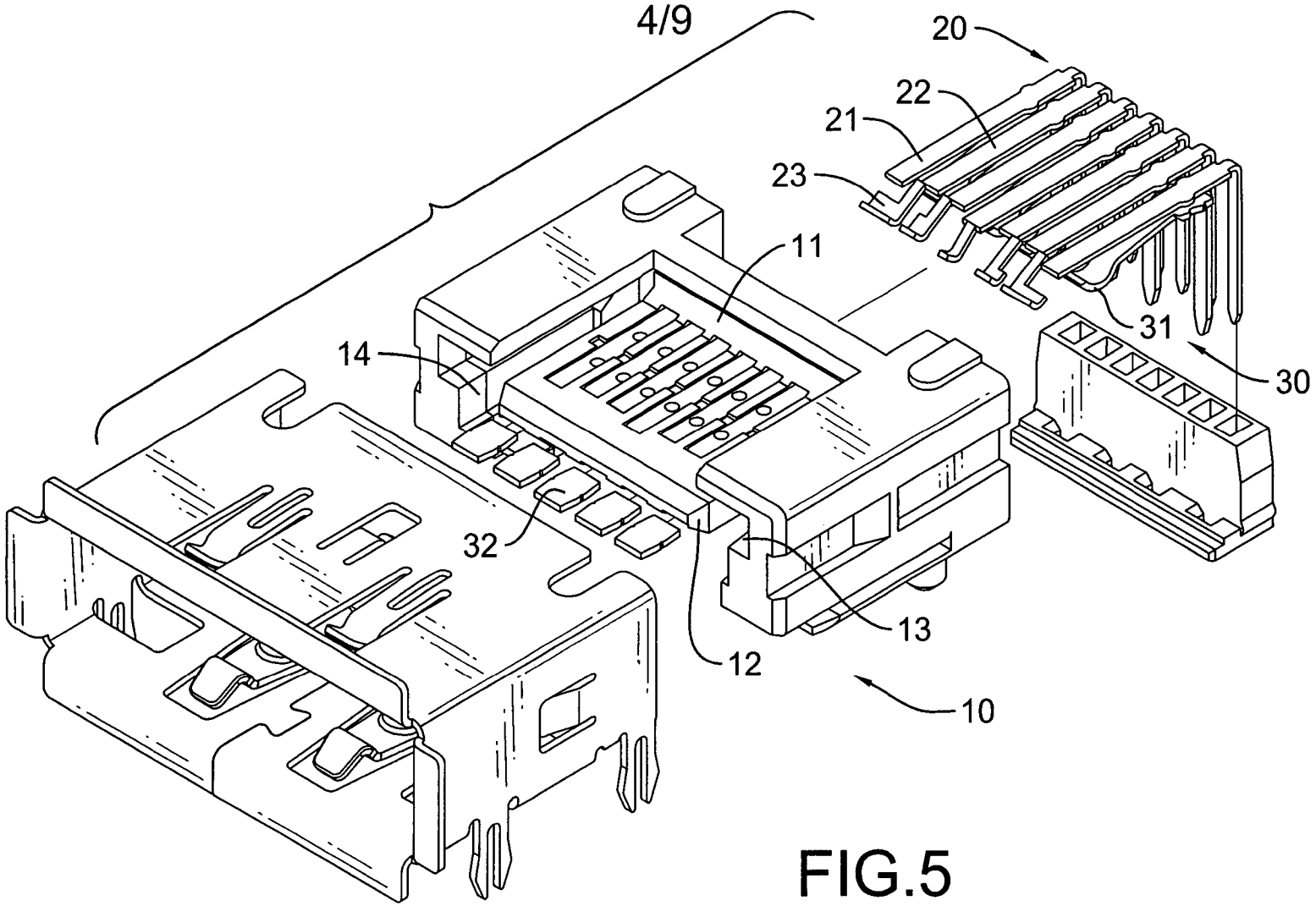
FIG. 5 is an exploded of perspective view of a second embodiment of a connector socket in accordance with the present invention.
Figure 6:
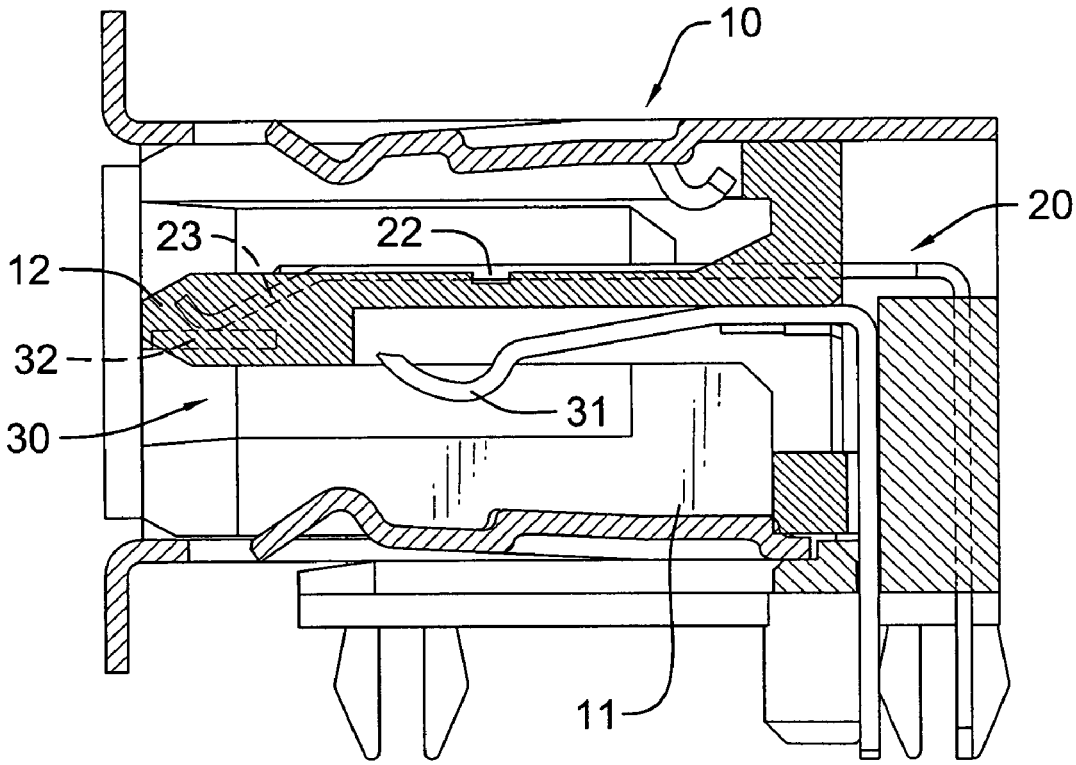
FIG. 6 is a side view in partial section of the connector socket in FIG. 5.
Figure 7:
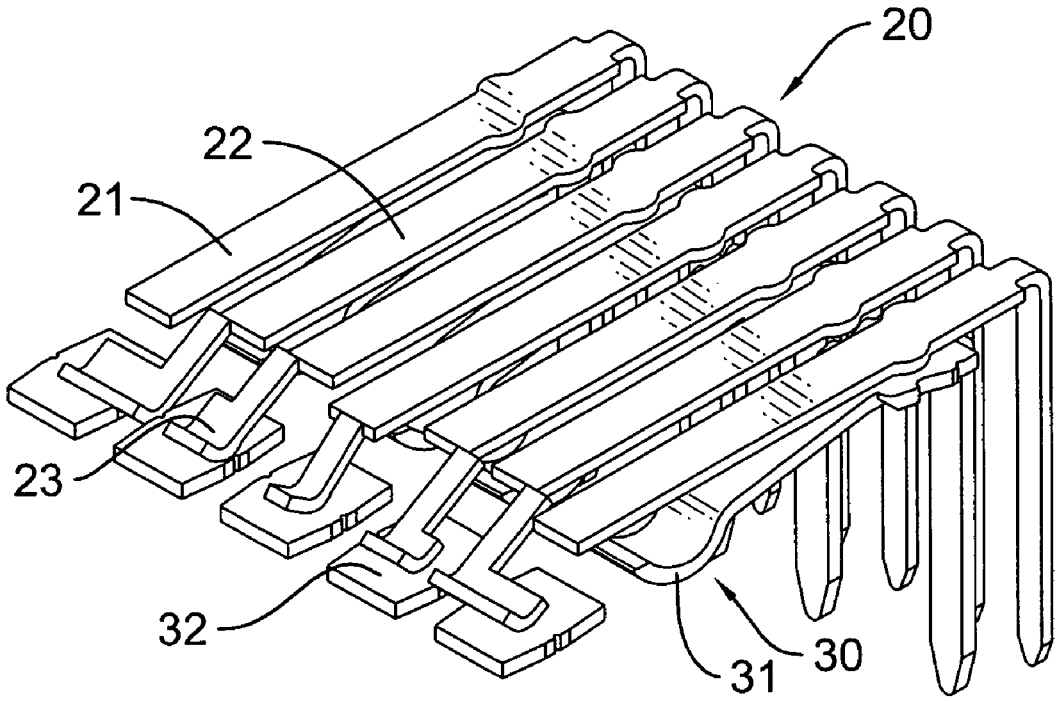
FIG. 7 is a perspective view of an eSATA contact set and an USB contact set of the connector socket in FIG. 5.
Figure 8:
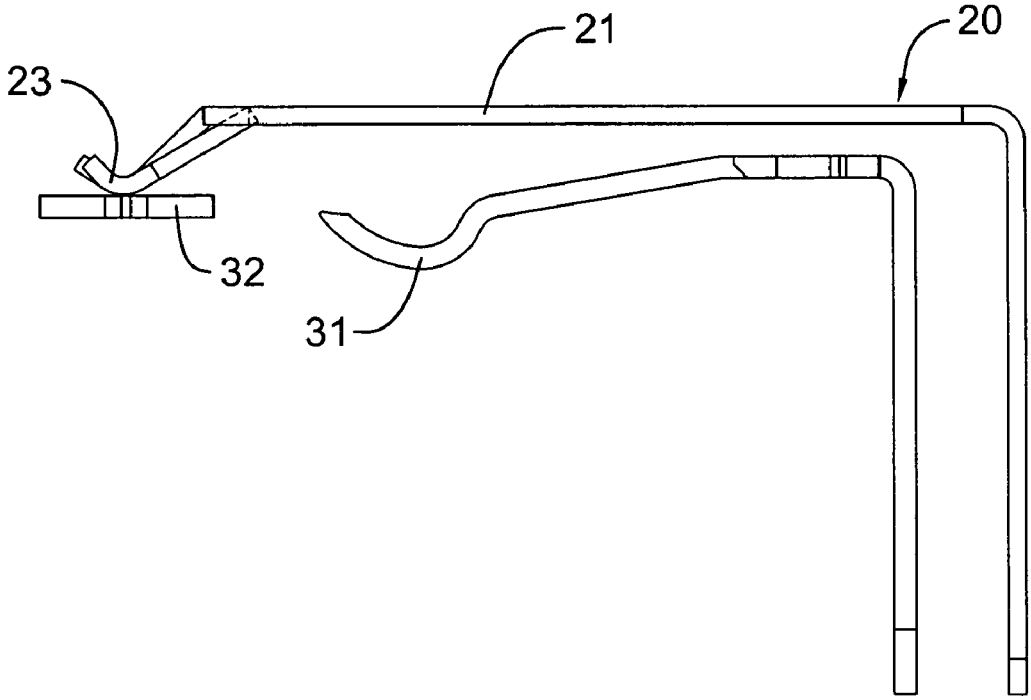
FIG. 8 a side view of the eSATA contact set and the USB contact set in FIG. 7.
Figure 9:
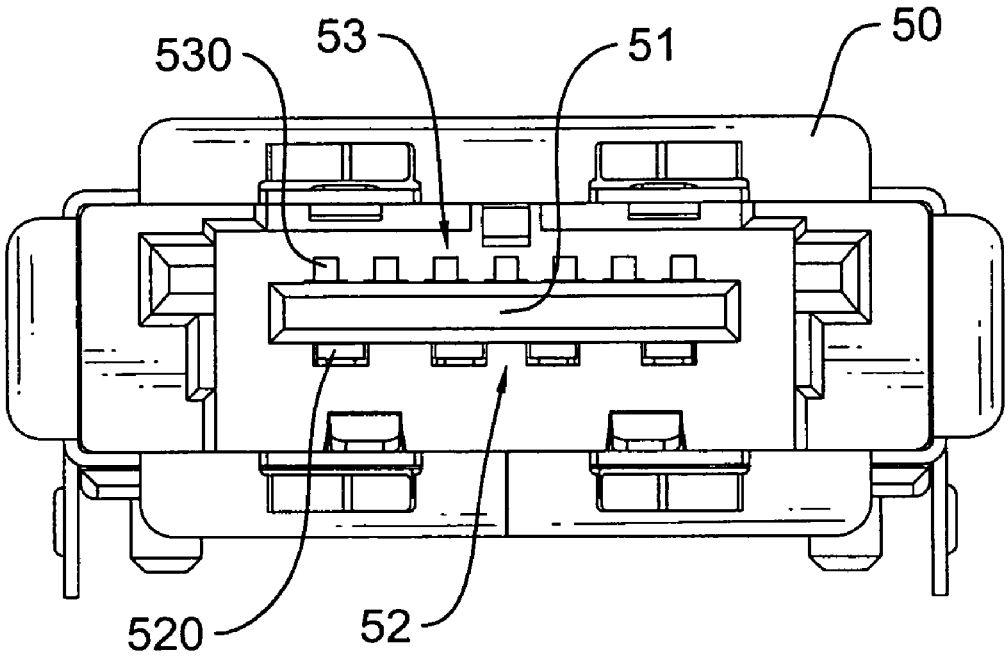
FIG.9 PRIOR ART
FIG. 9 is a front view of a conventional connector socket in accordance with the prior art.

With further reference to FIGS. 3 and 4, the exterior USB contacts (32) may be respectively formed on and protruding transversely from the front ends of the middle eSATA contacts (22). With further reference to FIGS. 7 and 8, each exterior USB contact (32) may be detachably mounted on the contact seat (12) close to the front opening and abut to an extension of a corresponding middle eSATA contact (22).

Figure 10:
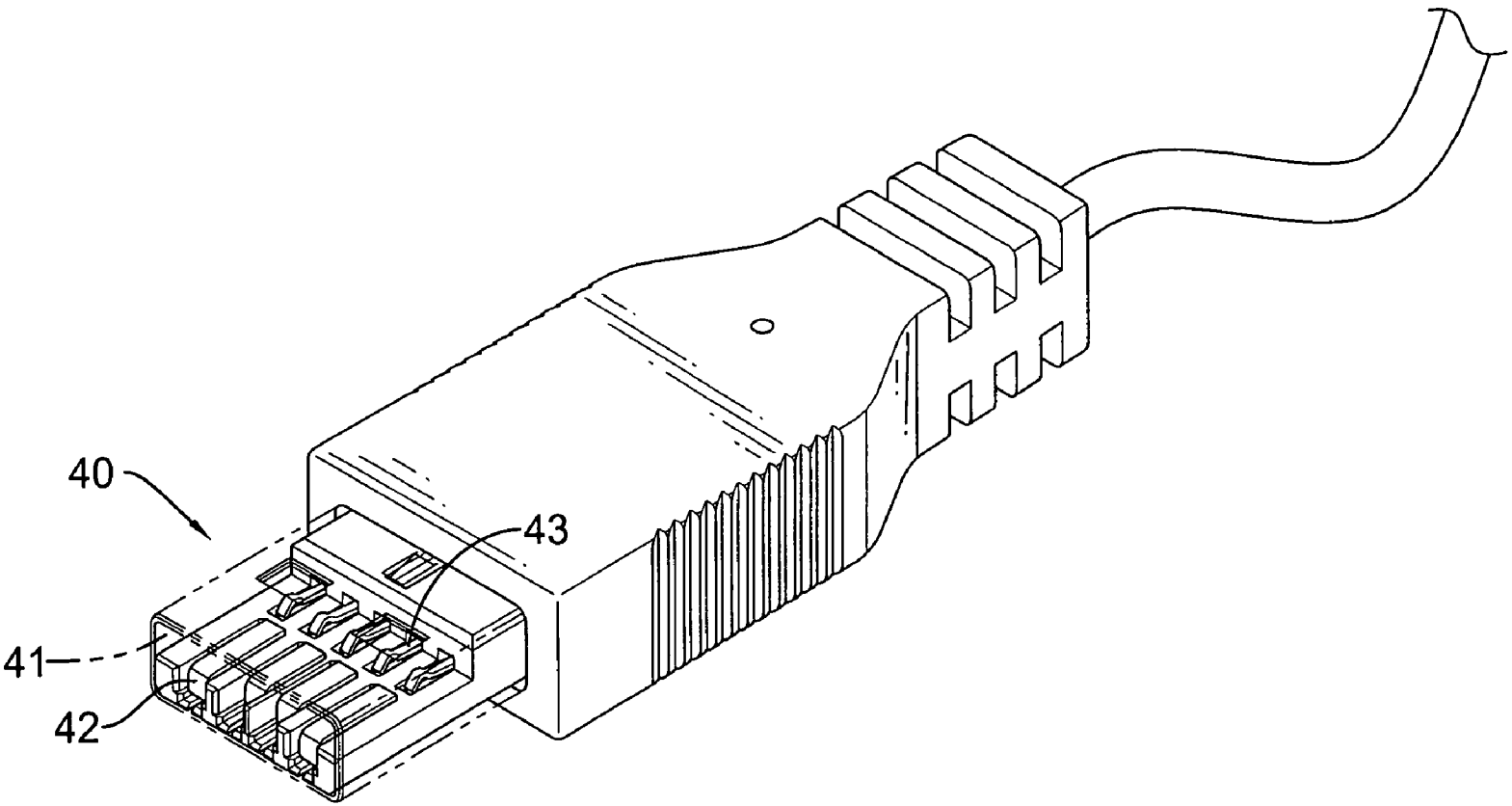
FIG.10 PRIOR ART
FIG. 10 is a perspective view of a standard USB 3.0 connector in accordance with the prior art.

With reference to FIG. 10, when the USB 3.0 plug (40) is mounted in the connector socket of the present invention, the contact seat (12) extends into the cavity (41) of the USB 3.0 plug (40). And the front contacts (42) of the USB 3.0 plug (40) respectively connect the interior USB contacts (31) of the connector socket. The rear contacts (43) respectively connect the exterior USB contacts (32). Therefore the connector socket performs a full transmission speed of USB 3.0. And the side eSATA contacts (21) are left unused for the time being. On the contrary, when the USB plug is removed and an eSATA plug is mounted in the connector socket through the eSATA plug outline (14), the interior USB contacts (31) are left unused for this time being.

In conclusion, the connector socket is compatible with USB and eSATA plugs and even compatible with USB plugs at 3.0 version. Furthermore, the connector socket remains one single contact seat (12) to be compact since the middle eSATA contacts share transmission paths with the exterior USB contacts (32).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A connector socket comprising:

a casing having a cavity being defined in the casing; and a contact-seat being disposed in the cavity;

an eSATA contact set being mounted on the contact seat and having side eSATA contacts being conductive and mounted on the contact seat; and middle eSATA contacts being conductive, arranged in a row between the side eSATA contacts and mounted on the contact seat; and an USB contact set being mounted on the contact seat opposite to the eSATA contact set and having multiple interior USB contacts being conductive and mounted on the contact seat; and multiple exterior USB contacts being conductive, mounted on the contact seat and respectively connecting the middle eSATA contacts.

2. The connector socket as claimed in claim 1, wherein the cavity has a front opening; and the exterior USB contacts are arranged in a row and close to the front opening.

3. The connector socket as claimed in claim 2, wherein the front opening of the cavity has an edge having stepped segments and forming an USB plug outline being adapted to correspond to an USB plug; and an eSATA plug outline being adapted to correspond to an eSATA plug.

4. The connector socket as claimed in claim 3, wherein each middle eSATA contact has a front end close to the front opening of the cavity and an extension formed on and protruding inclined down from the front end; and each exterior USB contact is detachably mounted on the contact seat close to the front opening and abuts an extension of a corresponding middle eSATA contact.

5. The connector socket as claimed in claim 2, wherein each middle eSATA contact has a front end close to the front opening of the cavity and an extension formed on and protruding inclined down from the front end; and each exterior USB contact is detachably mounted on the contact seat close to the front opening of the cavity and abuts an extension of a corresponding middle eSATA contact.

6. The connector socket as claimed in claim 1, wherein each middle eSATA contact has a front end; and the exterior USB contacts are respectively formed on and protruding transversely from the front ends of the eSATA contacts.

7. The connector socket as claimed in claim 2, wherein each middle eSATA contact has a front end close to the front opening of the cavity; and the exterior USB contacts are respectively formed on and protruding transversely from the front ends of the eSATA contacts.

8. The connector socket as claimed in claim 3, wherein each middle eSATA contact has a front end close to the front opening of the cavity; and the exterior USB contacts are respectively formed on and protruding transversely from the front ends of the eSATA contacts.

9. The connector socket as claimed in claim 1, wherein each middle eSATA contact has a front end and an extension formed on and protruding inclined down from the front end; and each exterior USB contact is detachably mounted on the contact seat and abuts to an extension of a corresponding middle eSATA contact.

* * * * *